US009194618B2

(12) United States Patent
Park et al.

(10) Patent No.: US 9,194,618 B2
(45) Date of Patent: Nov. 24, 2015

(54) AIR CONDITIONER

(71) Applicants: Junseong Park, Seoul (KR); Yongcheol Sa, Seoul (KR); Pilhyun Yoon, Seoul (KR)

(72) Inventors: Junseong Park, Seoul (KR); Yongcheol Sa, Seoul (KR); Pilhyun Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 407 days.

(21) Appl. No.: 13/648,437

(22) Filed: Oct. 10, 2012

(65) Prior Publication Data

US 2013/0091885 A1 Apr. 18, 2013

(30) Foreign Application Priority Data

Oct. 11, 2011 (KR) ..... 10-2011-0103657

(51) Int. Cl.

| | |
|---|---|
| ***F25B 30/02*** | (2006.01) |
| ***F25B 29/00*** | (2006.01) |
| ***F24F 1/14*** | (2011.01) |
| ***F24F 1/24*** | (2011.01) |

(52) U.S. Cl.

CPC . *F25B 30/02* (2013.01); *F24F 1/14* (2013.01); *F24F 1/24* (2013.01); *F25B 29/003* (2013.01)

(58) Field of Classification Search

CPC ..... F24F 1/14; F24F 1/24; F25B 29/003; F25B 2400/05

USPC ..... 62/160, 238.6, 259.2, 470

See application file for complete search history.

(56) References Cited

U.S. PATENT DOCUMENTS

| | | | | |
|---|---|---|---|---|
| 5,947,373 | A * | 9/1999 | Saito et al. | 237/2 B |
| 6,851,273 | B2 * | 2/2005 | Jang et al. | 62/324.5 |
| 6,865,904 | B2 * | 3/2005 | Wang | 62/324.1 |
| 7,377,119 | B2 * | 5/2008 | Kim et al. | 62/160 |
| 7,407,002 | B2 * | 8/2008 | Jang et al. | 165/240 |
| 2006/0123834 | A1 * | 6/2006 | Hwang et al. | 62/470 |

(Continued)

FOREIGN PATENT DOCUMENTS

| | | |
|---|---|---|
| EP | 2 306 101 | 4/2011 |
| JP | 05-187724 | 7/1993 |

(Continued)

OTHER PUBLICATIONS

Korean Notice of Allowance dated Aug. 23, 2013.

(Continued)

*Primary Examiner* — Emmanuel Duke

(74) *Attorney, Agent, or Firm* — Ked & Associates, LLP

(57) ABSTRACT

An air conditioner capable of cooling or heating an electronic component box provided to an outdoor unit is provided. An air conditioner includes a compressor, an outdoor heat exchanger, an indoor heat exchanger, an electronic component box and an electronic component box heat exchanger. The compressor compresses a refrigerant. The outdoor heat exchanger performs a heat exchange between outdoor air and the refrigerant, being disposed outdoors and connected to the compressor. The indoor heat exchanger performs a heat exchange between indoor air and the refrigerant, being disposed indoors and connected to the compressor and the outdoor heat exchanger. The electronic component box has electronic components accommodated therein, being disposed outdoors together with the outdoor heat exchanger. The electronic component box heat exchanger heat or cools the electronic component box through flow of the refrigerant, being provided in the electronic component box.

18 Claims, 4 Drawing Sheets

(56) References Cited

U.S. PATENT DOCUMENTS

| | | | | |
|---|---|---|---|---|
| 2009/0100848 | A1* | 4/2009 | Kuriyama et al. | 62/132 |
| 2010/0174412 | A1* | 7/2010 | Kwon et al. | 700/275 |
| 2011/0192176 | A1* | 8/2011 | Kim et al. | 62/115 |

FOREIGN PATENT DOCUMENTS

| | | | | |
|---|---|---|---|---|
| JP | 09-236283 | | 9/1997 | |
| JP | 2011-122779 | | 6/2011 | |
| JP | 2011122779 | * | 6/2011 | F25B 1/00 |
| KR | 10-2007-0052547 | | 5/2007 | |
| KR | 1020070052547 | * | 5/2007 | F24F 5/00 |
| WO | WO 2010/087481 | | 8/2010 | |

OTHER PUBLICATIONS

Korean Office Action dated Jan. 30, 2013.

European Search Report dated Mar. 11, 2013.

* cited by examiner

AIR CONDITIONER

BACKGROUND OF THE INVENTION

1. Field of the invention

The present invention relates to an air conditioner. More specifically, the present invention relates to an air conditioner capable of cooling or heating an electronic component box provided to an outdoor unit.

2. Description of the Conventional Art

In general, an air conditioner is a device that cools or heats the interior of a room using a cooling cycle including a compressor, an outdoor heat exchanger, an expansion valve and an indoor heat exchanger. That is, the air conditioner may be used as a cooler for cooling the interior of the room or a heater for heating the interior of the room. The air conditioner may be used as a cooling/heating air conditioner for heating or cooling the interior of the room.

The air conditioner is generally classified into a window type and a separate or split type. The window type and the separate or split type are functionally equal to each other. However, in the case of the window type, an integrated function of cooling and heat radiation is provided to a device, and the device is directly installed by drilling a hole in a wall of a house or by hanging the apparatus on a window. In the case of the separate or split type, an indoor unit having an indoor heat exchanger is installed indoor, and an outdoor unit having a compressor and an outdoor heat exchanger is installed outdoor, thereby connecting the two devices separated from each other through a refrigerant pipe.

The outdoor unit performs a heat exchange between outdoor air and refrigerant is performed in the outdoor heat exchanger, and is provided with an electronic component box in which electronic components for controlling a compressor of the outdoor unit, an indoor expansion valve, etc. are accommodated.

SUMMARY OF THE INVENTION

The invention has been made in an effort to provide an air conditioner capable of cooling or heating an electronic component box provided to an outdoor unit.

It is to be understood that technical problems to be solved by the present invention are not limited to the aforementioned technical problems and other technical problems which are not mentioned will be apparent from the following description to the person with an ordinary skill in the art to which the present invention pertains.

An air conditioner includes a compressor compressing a refrigerant; an outdoor heat exchanger performing a heat exchange between outdoor air and the refrigerant, being disposed outdoors and connected to the compressor; an indoor heat exchanger performing a heat exchange between indoor air and the refrigerant, being disposed indoors and connected to the compressor and the outdoor heat exchanger; an electronic component box having electronic components accommodated therein, being disposed outdoors together with the outdoor heat exchanger; and an electronic component box heat exchanger heating or cooling the electronic component box through flow of the refrigerant, being provided in the electronic component box.

Detailed items of other embodiments are included in detailed description and drawings.

DETAILED DESCRIPTION OF THE PREFERRED EMBODIMENTS

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
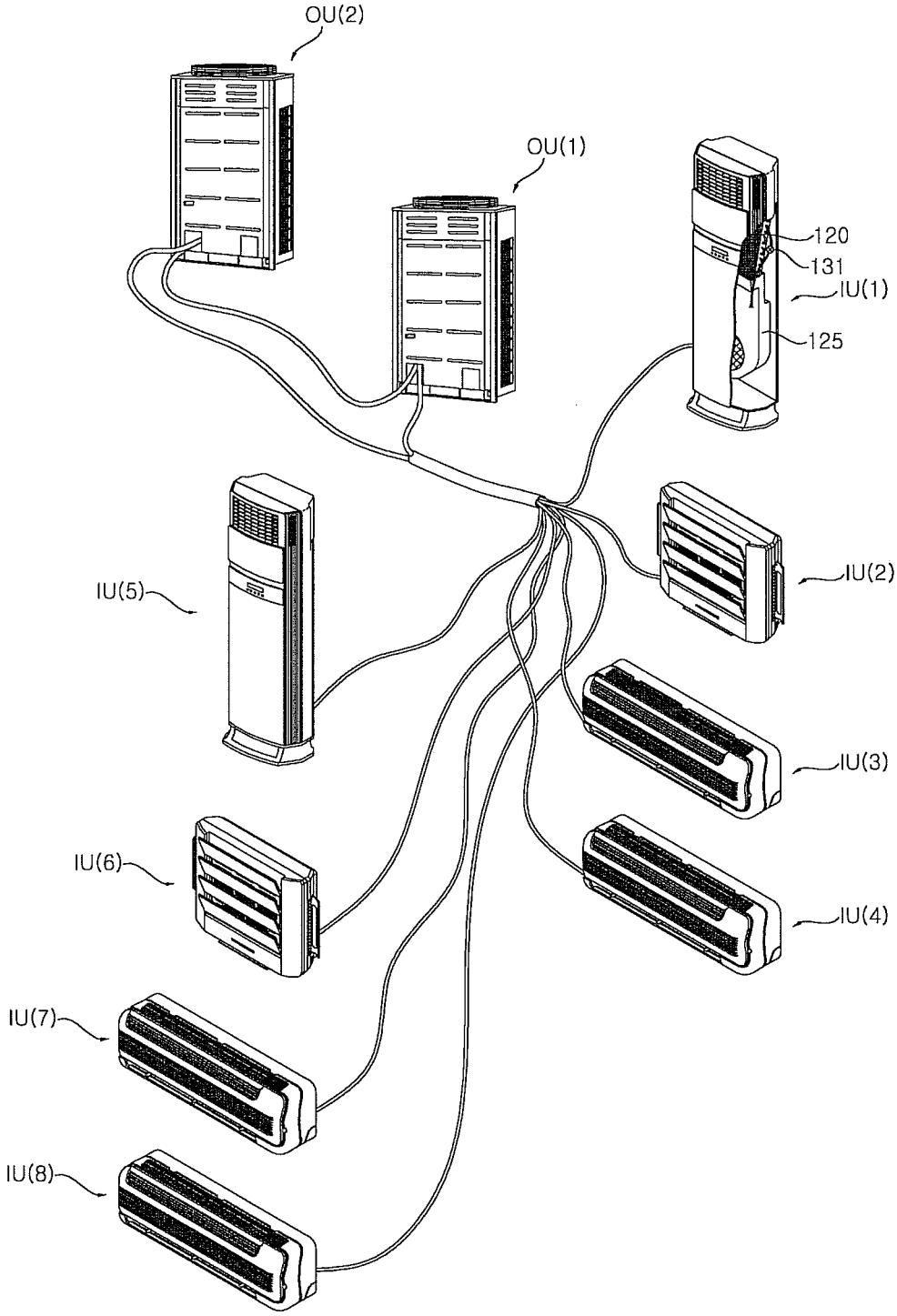
FIG. 1 is a schematic diagram of an air conditioner according to an embodiment of the present invention.
Figure 2:
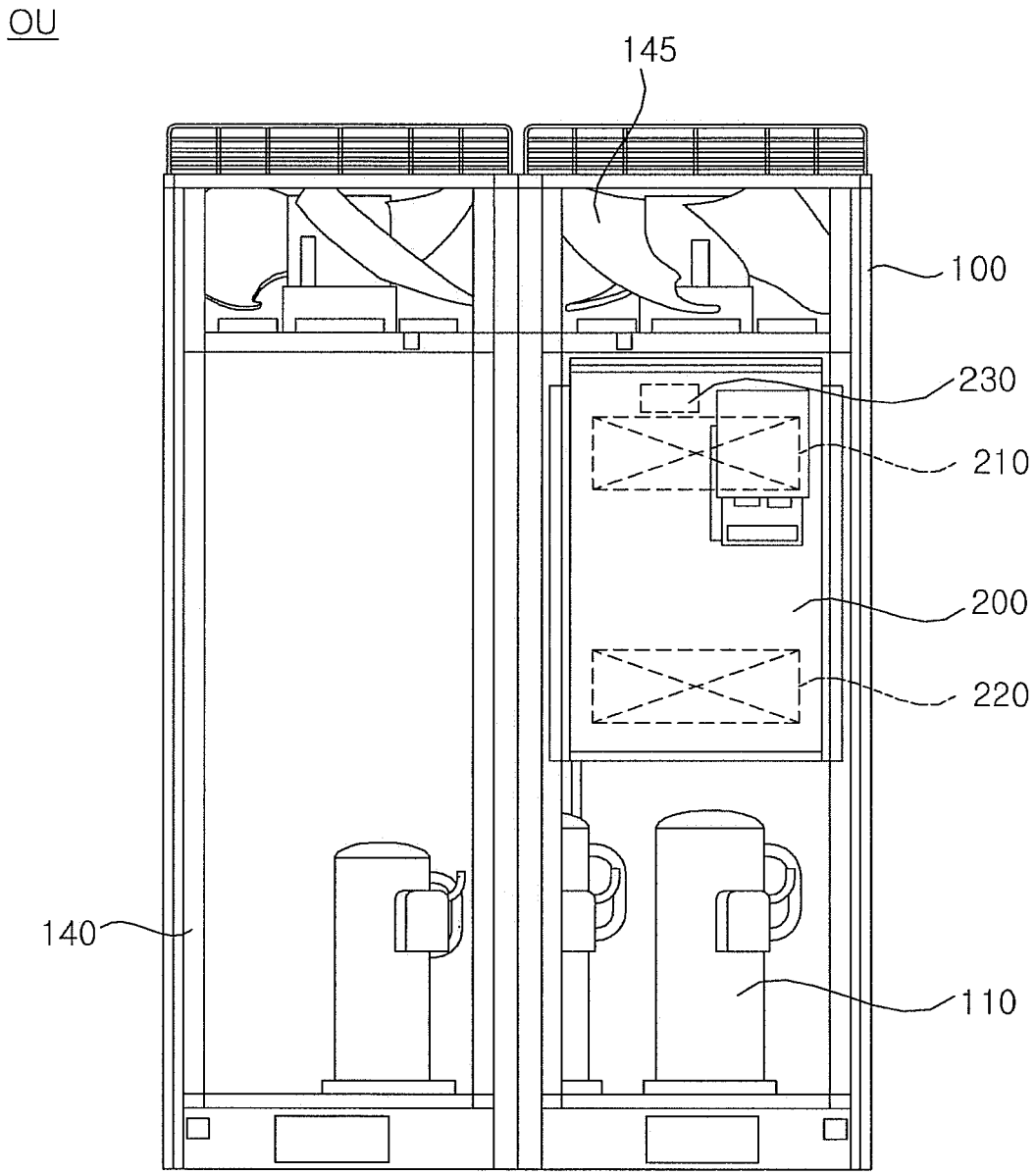
FIG. 2 is an internal configuration diagram of an outdoor unit in the air conditioner shown in FIG. 1.

FIG. 1 is a schematic diagram of an air conditioner according to an embodiment of the present invention. FIG. 2 is an internal configuration diagram of an outdoor unit in the air conditioner shown in FIG. 1.

The air conditioner according to the embodiment of the present invention includes a compressor 110 compressing a refrigerant, an outdoor heat exchanger 140 performing a heat exchange between outdoor air and the refrigerant, being disposed outdoors and connected to the compressor 110, an indoor heat exchanger 120 performing a heat exchange between indoor air and the refrigerant, being disposed indoors and connected to the outdoor heat exchanger 140, an electronic component box 200 accommodating electronic components therein, being disposed outdoors together with the outdoor heat exchanger 140, and an electronic component box heat exchanger 210 and 220 heating or cooling the electronic component box 200 through flow of the refrigerant, being provided in the electronic component box 200.

As shown in FIG. 1, the air conditioner according to the embodiment of the present invention is a multi-type air conditioner including a plurality of indoor units IU and a plurality of outdoor units OU connected to the plurality of outdoor units OU. In the multi-type air conditioner, cooling and heating are selectively performed.

Each of the plurality of indoor units IU includes an indoor heat exchanger 120 cooling or heating indoor air while performing a heat exchange between a refrigerant and the indoor air, an indoor air blower 125 performing a heat exchange with the indoor heat exchanger by sucking the indoor air into the indoor unit IU and then exhausting the heat-exchanged indoor air to the outside of the indoor unit IU, and an indoor expansion valve 131 expanding the refrigerant flowed toward the indoor heat exchanger 120.

In a cooling operation of the air conditioner, the indoor heat exchanger 120 acts as an evaporator that evaporates the refrigerant condensed in the outdoor heat exchanger 140 and expanded in the indoor expansion valve 131. In a heating operation of the air conditioner, the indoor heat exchanger 120 acts as a condenser that condenses the refrigerant compressed in the compressor 110.

Each of the plurality of outdoor units OU includes an outdoor unit case 100 forming an exterior appearance thereof, a compressor 110, an outdoor heat exchanger 140, an outdoor air blower 145 and an electronic component case 200.

The outdoor unit case 100 forms the exterior appearance of the outdoor unit OU, and the compressor 110, the outdoor heat exchanger 140, the outdoor air blower 145 and the electronic component box 200 are provided in the outdoor unit case 100. The compressor 110 may be disposed at a lower part of the outdoor unit case 100, and the indoor heat exchanger 140 may be disposed to face three of side surfaces of the outdoor unit case 100. The outdoor air blower 145 may be disposed at an upper part of the outdoor unit case 100, and the electronic component box 200 may be disposed between the compressor 110 and the outdoor air blower 145 at an inner middle part of the outdoor unit case 100.

The compressor 110 is used to compress the refrigerant, and may be provided with a plurality of compressors. In a case where the compressor 110 is provided with a plurality of compressors, any one of the compressors may be an inverter compressor, and the others of the compressors may be constant speed compressors.

In the cooling operation of the air conditioner, the outdoor heat exchanger 140 acts as a condenser that condenses the refrigerant compressed in the compressor 110. In the heating operation of the air conditioner, the outdoor heat exchanger 140 acts as an evaporator that evaporates the refrigerant condensed in the outdoor heat exchanger 140.

Electronic components necessary for the operation of the air conditioner are accommodated in the electronic component box 200. The electronic components accommodated in the electronic component box 200 controls the compressor 110 and various kinds of valves such as an outdoor expansion valve and a 4-way valve, which will be described later, so as to meet operational conditions. The electronic components accommodated in the electronic component box 200 may include various electronic components such as a circuit board, a capacitor, a switching element, a converter and an inverter. The electronic component box 200 is provided in the outdoor unit case 100 and is preferably disposed between the compressor 110 and the outdoor air blower 145.

The electronic component box heat exchangers 210 and 220 heat or cool the electronic component box 200, being provided in the electronic component box 200. A portion of the refrigerant flowed from the compressor 100 to the indoor heat exchanger 120 may flow in the electronic component box heat exchangers 210 and 220, or a portion of the refrigerant flowed from the indoor heat exchanger 120 to the compressor 110 may flow in the electronic component box heat exchangers 210 and 220. The electronic component box heat exchangers 210 and 220 may include a first electronic component box heat exchanger 210 in which a portion of the refrigerant flowed from the indoor heat exchanger 120 to the compressor 110 flows, and a second electronic component box heat exchanger 220 in which a portion of the refrigerant flowed from the compressor 100 to the indoor heat exchanger 120 flows.

In the cooling operation of the air conditioner, a portion of a low-temperature refrigerant evaporated in the indoor heat exchanger 120 flows in the first electronic component box heat exchanger 210, and thus the first electronic component box heat exchanger 210 cools the electronic component box 200. In a case where the temperature of the outside, at which the outdoor unit OU including the electronic component box 200 is installed, is high, the cooling operation is performed. Therefore, a portion of the low-temperature refrigerant evaporated in the indoor heat exchanger 120 flows in the first electronic component box heat exchanger 210 so as to cool the electronic component box 200.

In the heating operation of the air conditioner, a portion of a high-temperature refrigerant compressed in the compressor 110 flows in the second electronic component box heat exchanger 220, and thus the second electronic component box heat exchanger 220 heats the electronic component box 200. In a case where the temperature of the outside, at which the outdoor unit OU including the electronic component box 200 is installed, is low, the heating operation is performed. Therefore, a portion of the high-temperature refrigerant compressed in the compressor 110 flows in the second electronic component box heat exchanger 220 so as to heat the electronic component box 200.

An electric heater 230 heating the electronic component box 200 may be provided in the electronic component box 200. The electric heater 230 may heat the electronic component box 200 when the air conditioner does not operate. In a case where the outdoor unit OU including the electronic component box 200 maintains a low temperature, but the compressor 110 does not compress the refrigerant due to no operation of the air conditioner, the second electronic component box heat exchanger 220 cannot heat the electronic component box 200. In this case, the electric heater 230 may heat the electronic component box 200 using electric power.

Figure 3:
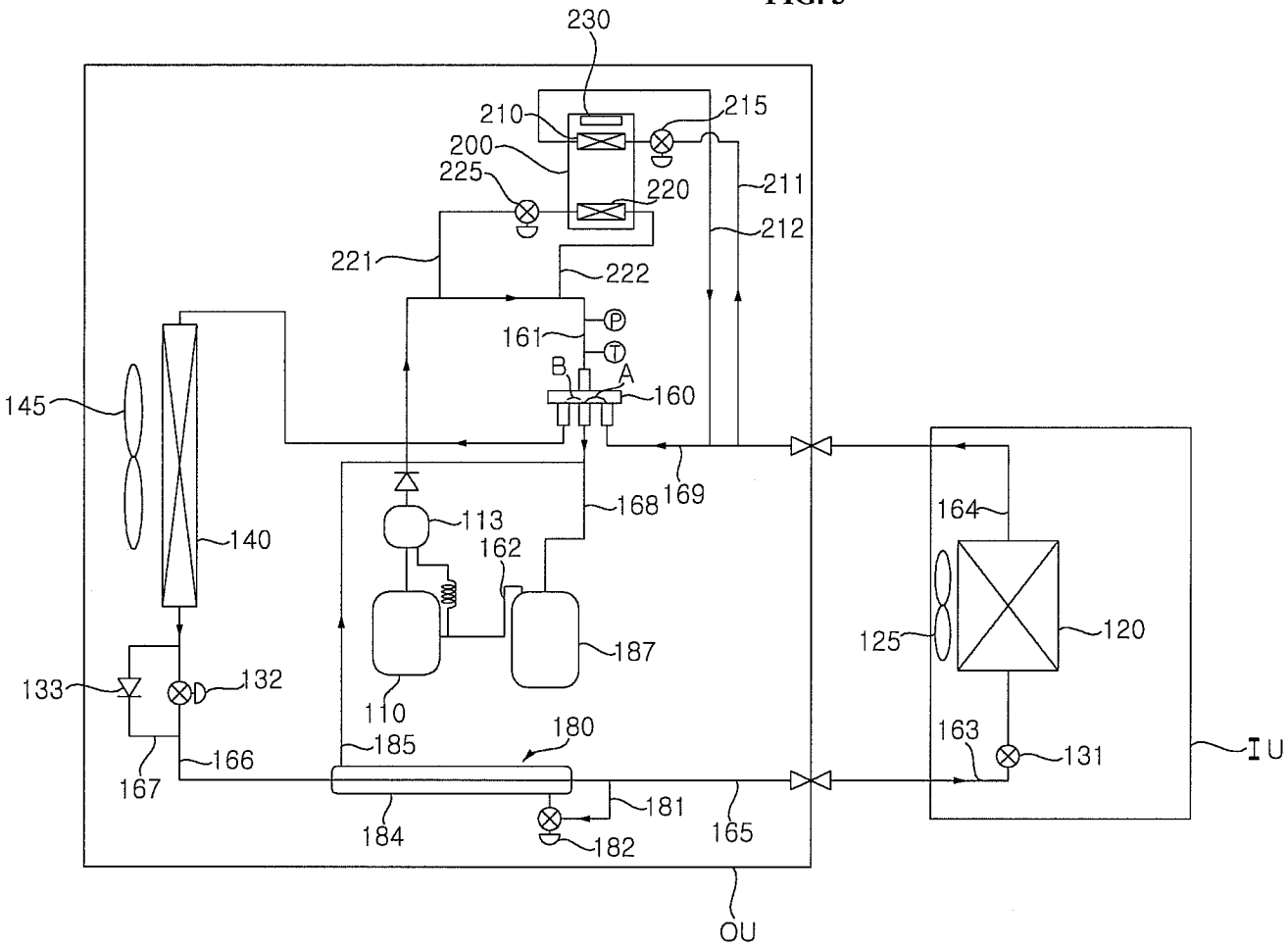
FIG. 3 is a configuration diagram of the air conditioner in a cooling operation according to an embodiment of the present invention.
Figure 4:
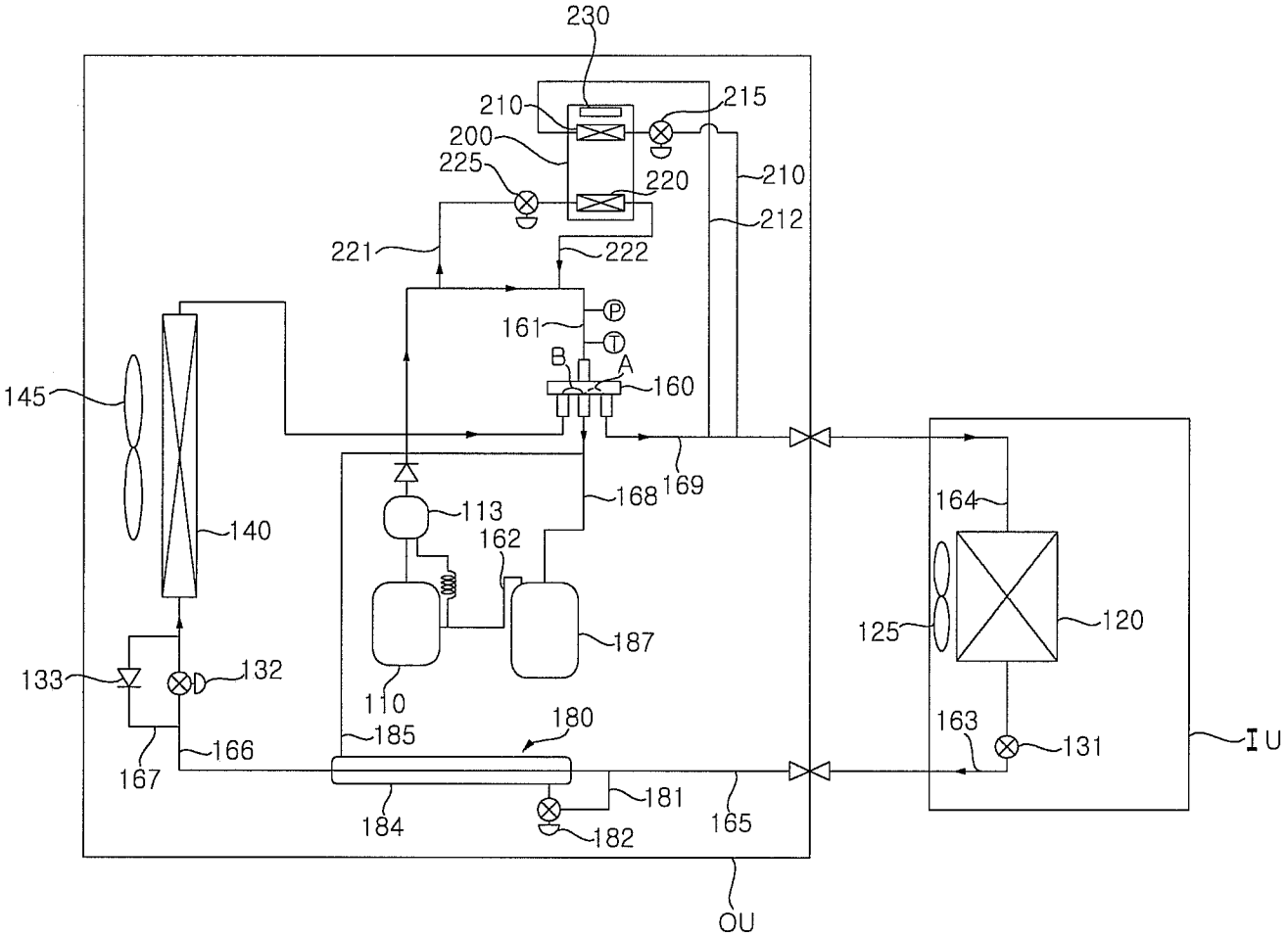
FIG. 4 is a configuration diagram of the air conditioner in a heating operation according to an embodiment of the present invention.

FIG. 3 is a configuration diagram of the air conditioner in a cooling operation according to an embodiment of the present invention. FIG. 4 is a configuration diagram of the air conditioner in a heating operation according to an embodiment of the present invention.

A high-temperature and high-pressure refrigerant compressed in the compressor 110 flows, being exhausted through an outlet pipe 161. An oil separator 113 may be installed in the outlet pipe 161 of the compressor 110 so as to separate oil from the refrigerant exhausted in the compressor 110. The outlet pipe 161 is connected to a 4-way valve 160 so that the refrigerant compressed in the compressor 110 flows in the 4-way valve 160.

The 4-way valve 160 is a flow switching valve for switching between the cooling and heating operations. The 4-way valve 160 is connected to the outlet pipe 161, the outdoor heat exchanger 140, the indoor heat exchanger 120 and an accumulator 187. In the cooling operation of the air conditioner, the 4-way valve 160 guides, to the outdoor heat exchanger 140, the refrigerant compressed in the compressor 110 and exhausted through the outlet pipe 161. In the heating operation of the air conditioner, the 4-way valve 160 guides, to the indoor heat exchanger 120, the refrigerant compressed in the compressor 110 and exhausted through the outlet pipe 161. In the embodiment of the present invention, the 4-way valve 160 is in state A in the cooling operation of the air conditioner and is in state B in the heating operation of the air conditioner.

An outdoor expansion valve 132 connected to the outdoor heat exchanger 140 expands the refrigerant flowed in the outdoor heat exchanger 140 in the heating operation of the air conditioner. The outdoor expansion valve 132 is installed on an inlet pipe 166 that connects a liquid pipe 165 and the outdoor heat exchanger 140 therethrough. A first bypass pipe 167 for allowing the refrigerant to bypass the outdoor expansion valve 132 is installed on the inlet pipe 166, and a check valve 133 is installed on the first bypass pipe 167.

In the cooling operation of the air conditioner, the check valve 133 allows the refrigerant to flow from the outdoor heat exchanger 140 to the indoor unit IU. However, in the heating operation of the air conditioner, the check valve 133 cuts off the flow of the refrigerant.

A supercooler 180 includes a supercooling heat exchanger 184, a second bypass pipe 181, a supercooling expansion valve 182 and an exhaust pipe 185. The supercooling heat exchanger 184 is disposed on the inlet pipe 166. The second bypass pipe 181 allows a portion of the refrigerant passing through the supercooling heat exchanger 184 to be flowed in the supercooling expansion valve 182 in the cooling operation of the air conditioner.

The supercooling expansion valve 182 is disposed on the second bypass pipe 181. The supercooling expansion valve 182 lowers the pressure and temperature of a liquid refrigerant by expanding the refrigerant flowed in the second bypass pipe 181 and then allows the refrigerant to be flowed in the supercooling heat exchanger 184.

In the cooling operation of the air conditioner, the refrigerant condensed in the outdoor heat exchanger 140 is supercooled by being heat-exchanged with the low-temperature refrigerant flowed in the supercooling heat exchanger 184 through the second bypass pipe 181 in the supercooling heat exchanger 184, and then flows in the indoor unit IU.

The refrigerant passing through the second bypass pipe 181 is heat-exchanged in the supercooling heat exchanger 184 and then flowed in the accumulator 187 through the exhaust pipe 185.

The indoor expansion valve 131 is installed in an indoor entrance pipe 163 of the indoor unit IU, connected to the liquid pipe 165. The indoor expansion valve 131 may be opened with an opening degree set in the cooling operation of the air conditioner, and may be completely opened in the heating operation of the air conditioner.

The 4-way valve 160 and the indoor unit IU are connected through a gas pipe 169. The gas pipe 169 is connected to the indoor heat exchanger 120 through an indoor exit pipe 164.

A first electronic component box inlet pipe 211 is connected to the first electronic component box heat exchanger 210, being branched from the gas pipe 169. In the cooling operation of the air conditioner, the first electronic component box inlet pipe 211 guides, to the first electronic component box heat exchanger 210, a portion of the refrigerant flowing from the indoor heat exchanger 120 to the 4-way valve 160.

A first electronic component box outlet pipe 212 guides the refrigerant passing through the first electronic component box heat exchanger 210 to join the gas pipe 169.

A first electronic component box valve 215 controlling the flow of the refrigerant is disposed on the first electronic component box inlet pipe 211. The first electronic component box valve 215 is opened in the cooling operation of the air conditioner and is closed in the heating operation of the air conditioner. In the cooling operation of the air conditioner, the first electronic component box valve 215 is opened so that a portion of the refrigerant flowing from the indoor heat exchanger 120 to the 4-way valve 160 is flowed in the first electronic component box inlet pipe 211. In the heating operation of the air conditioner, the first electronic component box valve 215 is closed so that a portion of the refrigerant flowing from the 4-way valve 160 to the indoor heat exchanger 120 is not flowed in the first electronic component box inlet pipe 211.

A second electronic component box inlet pipe 221 is connected to the second electronic component box heat exchanger 220, being branched from the outlet pipe 161 in the heating operation of the air conditioner, the second electronic component box inlet pipe 221 guides, to the second electronic component box heat exchanger 220, a portion of the refrigerant flowing from the compressor 110 to the 4-way valve 160.

A second electronic component box outlet pipe 222 guides the refrigerant passing through the second electronic component box heat exchanger 220 to join the outlet pipe 161.

A second electronic component box valve 225 controlling the flow of the refrigerant is disposed on the second electronic component box inlet pipe 221. The second electronic component box valve 225 is opened in the heating operation of the air conditioner and is closed in the cooling operation of the air conditioner. In the heating operation of the air conditioner, the second electronic component box valve 225 is opened so that a portion of the refrigerant flowing from the compressor 110 to the 4-way valve 160 flows in the second electronic component box inlet pipe 221. In the cooling operation of the air conditioner, the second electronic component box valve 225 is closed so that a portion of the refrigerant flowing from the compressor 110 to the 4-way valve 160 does not flow in the second electronic component box inlet pipe 221.

According to an embodiment of the present invention, the second electronic component box inlet pipe 221, the second electronic component box valve 225, the second electronic component box heat exchanger 220 and the second electronic component box outlet pipe 212 may not be used.

In the cooling operation of the air conditioner, the low-temperature refrigerant exhausted from the indoor heat exchanger 120 flows in the first electronic component box inlet pipe 211 so that the first electronic component box heat exchanger 210 can cool the electronic component box 200. In the heating operation of the air conditioner, the high-temperature refrigerant flowed in the indoor heat exchanger 120 flows in the first electronic component box inlet pipe 211 so that the first electronic component box heat exchanger 210 can heat the electronic component box 200. That is, if the first electronic component box valve 215 is opened regardless of cooling and heating, the first electronic component box heat exchanger 210 can cool the electronic component box 200 in the cooling operation of the air conditioner and can heat the electronic component box 200 in the heating operation of the air conditioner.

Hereinafter, the flow of the refrigerant in the cooling operation of the air conditioner will be described with reference to FIG. 3.

A high-temperature and high-pressure gaseous refrigerant exhausted to the outlet pipe 161 from the compressor 110 is flowed in the outdoor heat exchanger 140 via the 4-way valve 160. The refrigerant is condensed, being heat-exchanged with outdoor air in the outdoor heat exchanger 140. The refrigerant flowed out from the outdoor heat exchanger 140 is flowed in the supercooler 180 through the completely opened outdoor expansion valve 132 and the bypass pipe 133. The refrigerant flowed in the supercooler 180 is supercooled in the supercooling heat exchanger 184 and then flowed in the indoor unit IU along the liquid pipe 165.

A portion of the refrigerant supercooled in the supercooling heat exchanger 184 is expanded to supercool the refrigerant passing through the supercooling heat exchanger 184. The refrigerant supercooled in the supercooling heat exchanger 184 is flowed in the accumulator 187.

The refrigerant flowed in the indoor unit IU is expanded in the indoor expansion valve 131 opened with the opening degree set in the indoor unit IU and then evaporated by being heat-exchanged with indoor air in the indoor heat exchanger 120. The refrigerant evaporated in the indoor heat exchanger 120 is flowed in the 4-way valve 160 through the gas pipe 169 and then flowed in the compressor 110 via the accumulator 187.

If the first electronic component box valve 215 is opened in the cooling operation of the air conditioner, a portion of the refrigerant evaporated in the indoor heat exchanger 120 cools the electronic component box 200 by being flowed in the first electronic component box heat exchanger 210 via the first electronic component box inlet pipe 211. The refrigerant cooling the first electronic component box heat exchanger 210 joins the gas pipe 169 via the first electronic component box outlet pipe 212 and flows in the 4-way valve 160.

Hereinafter, the flow of the refrigerant in the heating operation of the air conditioner will be described with reference to FIG. 4.

A high-temperature and high-pressure gaseous refrigerant exhausted from the compressor 110 to the outlet pipe 161 is flowed in the indoor unit IU along the gas pipe 169 via the 4-way valve 160. The refrigerant flowed in the indoor unit IU is condensed by being heat-exchanged with the indoor air in the indoor heat exchanger 120. The refrigerant condensed in the indoor heat exchanger 120 passes through the completely opened indoor expansion valve 131 and then flows in the outdoor unit OU along the liquid pipe 165.

The refrigerant flowed from the indoor unit Ill to the outdoor unit OU is expanded in the outdoor expansion valve 132 and then evaporated by being heat-exchanged with the outdoor air in the outdoor heat exchanger 140. The evaporated refrigerant is flowed in a suction pipe 162 of the compressor 110 via the 4-way valve 160 and the accumulator 187.

If the second electronic component valve 225 is opened in the heating operation of the air conditioner, a portion of the refrigerant exhausted from the compressor 110 to the outlet pipe 161 heats the electronic component box 200 by being flowed in the second electronic component box heat exchanger 220 via the second electronic box inlet pipe 221. The refrigerant heating the second electronic component box heat exchanger 220 joins the outlet pipe 161 via the second electronic component box outlet pipe 212 and flows in the 4-way valve 160.

If the first electronic component box valve 215 is opened in the heating operation of the air conditioner, a portion of the refrigerant exhausted from the compressor 110 to the outlet pipe 161 and then flowed in the gas pipe 169 via the 4-way valve 160 heats the electronic component box 200 by being flowed in the first electronic component box heat exchanger 210 via the first electronic component box inlet pipe 211. The refrigerant heating the first electronic component box heat exchanger 210 joins the gas pipe 169 via the first electronic component box outlet pipe 212 and flows in the indoor heat exchanger 120.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Such modified embodiments should not be understood as being separate from the technical spirit or scope of the present invention, but should be interpreted as being included in the accompanying claims of the present invention.

According to the outdoor unit bracket and the outdoor unit comprising the same of the present invention, one or more effects can be obtained as follows.

First, it is possible to improve reliability and to enlarge an operational area by heating or cooling an electronic component box in which electronic components are accommodated.

Second, the electronic component box can be efficiently heated or cooled using a high-temperature or low-temperature refrigerant.

Third, the electronic component box can be heated or cooled according to the cooling/heating operation mode of the air conditioner.

Fourth, the electronic component box can be heated even when the air conditioner does not operate.

The effects of the present invention are not limited to the above-described effects and other effects which are not described herein will become apparent to those skilled in the art from the accompanying claims.

What is claimed is:

1. An air conditioner, comprising:

a compressor that compresses a refrigerant;

an outdoor heat exchanger that performs heat exchange between outdoor air and the refrigerant, disposed outdoors and connected to the compressor;

an indoor heat exchanger that performs heat exchange between indoor air and the refrigerant, disposed indoors and connected to the compressor and the outdoor heat exchanger;

an electronic component box having electronic components accommodated therein, provided outdoors together with the outdoor heat exchanger in an outdoor case;

an outlet pipe connected to the compressor through which the refrigerant exhausted from the compressor flows;

a 4-way valve connected to the outlet pipe to guide, to the outdoor heat exchanger, the refrigerant compressed in the compressor and exhausted through the outlet pipe in a cooling operation of the air conditioner, and to guide, to the indoor heat exchanger, the refrigerant compressed in the compressor and exhausted through the outlet pipe in a heating operation of the air conditioner;

a gas pipe that connects the 4-way valve and the indoor heat exchanger;

a first electronic component box heat exchanger provided in the electronic component box to cool the electronic component box through flow of the refrigerant in the cooling operation of the air conditioner;

a second electronic component box heat exchanger provided in the electronic component box to heat the electronic component box through flow of the refrigerant in the heating operation of the air conditioner;

a first electronic component box inlet pipe connected to the first electronic component box heat exchanger, branched from the gas pipe; and a second electronic component box inlet pipe connected to the second electronic component box heat exchanger, branched from the outlet pipe.

2. The air conditioner of claim 1, further comprising:

a first electronic component box valve that controls a flow of the refrigerant, disposed on the first electronic component box inlet pipe.

3. The air conditioner of claim 2, further comprising a first electronic component box outlet pipe that guides the refrigerant passing through the first electronic component box heat exchanger to join the gas pipe.

4. The air conditioner of claim 3, wherein the first electronic component box valve is opened in the cooling operation of the air conditioner and is closed in the heating operation of the air conditioner.

5. The air conditioner of claim 4, further comprising:

a second electronic component box valve that controls a flow of the refrigerant, disposed on the second electronic component box inlet pipe.

6. The air conditioner of claim 5, further comprising a second electronic component box outlet pipe that guides the refrigerant passing through the second electronic component box heat exchanger to join the outlet pipe.

7. The air conditioner of claim 5, wherein the second electronic component box valve is opened in the heating operation of the air conditioner and is closed in the cooling operation of the air conditioner.

8. The air conditioner of claim 1, further comprising an electric heater that heats the electronic component box, provided in the electronic component box.

9. An outdoor device of an air conditioner, comprising:

a compressor that compresses a refrigerant;

an outdoor heat exchanger that performs heat exchange between outdoor air and the refrigerant, connected to the compressor;

an electronic component box having electronic components accommodated therein, connected to the compressor;

an outlet pipe connected to the compressor through which the refrigerant exhausted from the compressor flows;

a 4-way valve connected to the outlet pipe to guide, to the outdoor heat exchanger, the refrigerant compressed in the compressor and exhausted through the outlet pipe in a cooling operation of the air conditioner;

a first electronic component box heat exchanger provided in the electronic component box to cool the electronic component box through flow of the refrigerant in the cooling operation of the air conditioner;

a second electronic component box heat exchanger provided in the electronic component box to heat the electronic component box through flow of the refrigerant in a heating operation of the air conditioner;

a gas pipe configured to connect the 4-way valve to an indoor heat exchanger;

a first electronic component box inlet pipe connected to the first electronic component box heat exchanger, branched from the gas pipe; and a second electronic component box inlet pipe connected to the second electronic component box heat exchanger, branched from the outlet pipe.

10. The outdoor device of claim 9, further comprising a first electronic component box valve that controls a flow of the refrigerant, disposed on the first electronic component box inlet pipe.

11. The outdoor device of claim 10, further comprising a first electronic component box outlet pipe that guides the refrigerant passing through the first electronic component box heat exchanger to join the gas pipe.

12. The outdoor device of claim 11, further comprising a second electronic component box valve that controls a flow of the refrigerant, disposed on the second electronic component box inlet pipe.

13. The outdoor device of claim 12, further comprising a second electronic component box outlet pipe that guides the refrigerant passing through the second electronic component box heat exchanger to join the outlet pipe.

14. An air conditioner, comprising:

a compressor that compresses a refrigerant;

an outdoor heat exchanger that performs heat exchange between outdoor air and the refrigerant, disposed outdoors and in communication with the compressor;

an indoor heat exchanger that performs heat exchange between indoor air and the refrigerant, disposed indoors and in communication with the compressor and the outdoor heat exchanger;

an electronic component box having electronic components accommodated therein, provided outdoors together with the outdoor heat exchanger in an outdoor case;

a first electronic component box heat exchanger provided in the electronic component box to cool the electronic component box through flow of the refrigerant in a cooling operation of the air conditioner;

a second electronic component box heat exchanger provided in the electronic component box to heat the electronic component box through flow of the refrigerant in a heating operation of the air conditioner;

a 4-way valve that guides, to the outdoor heat exchanger, the refrigerant compressed in the compressor and exhausted therefrom in the cooling operation and guides, to the indoor heat exchanger, the refrigerant compressed in the compressor and exhausted therefrom in the heating operation;

a first electronic component box inlet pipe connected to the first electronic component box heat exchanger, that guides a portion of the refrigerant exhausted from the indoor heat exchanger into the first electronic component box heat exchanger; and a second electronic component box inlet pipe connected to the second electronic component box heat exchanger, that guides a portion of the refrigerant exhausted by the compressor into the second electronic component box heat exchanger.

15. The air conditioner of claim 14, further comprising:

a first electronic component box valve that controls a flow of the refrigerant, disposed on the first electronic box inlet pipe.

16. The air conditioner of claim 15, further comprising a first electronic component box outlet pipe that guides the refrigerant passing through the first electronic component box heat exchanger to join the gas pipe.

17. The air conditioner of claim 16, further comprising a second electronic component box valve that controls a flow of the refrigerant, disposed on the second electronic component box inlet pipe.

18. The air conditioner of claim 17, further comprising a second electronic component box outlet pipe that guides the refrigerant passing through the second electronic component box heat exchanger to join the outlet pipe.

* * * * *